United States Patent [19]

Oblaender et al.

[11] Patent Number: 4,829,963

[45] Date of Patent: May 16, 1989

[54] METHOD FOR THE REGULATION OF THE MIXTURE COMPOSITION IN A MIXTURE-COMPRESSING INTERNAL COMBUSTION ENGINE

[75] Inventors: Kurt Oblaender, Kernen; Joerg Abthoff, Pluederhausen; Karlwalter Schmidt, Weinstadt, all of Fed. Rep. of Germany

[73] Assignee: Daimler-Benz Aktiengesellschaft, Stuttgart, Fed. Rep. of Germany

[21] Appl. No.: 144,063

[22] Filed: Jan. 15, 1988

[30] Foreign Application Priority Data

Jan. 15, 1987 [DE] Fed. Rep. of Germany ..... 3700942

[51] Int. Cl.[4] ..... F02D 41/14

[52] U.S. Cl. ..... 123/436

[58] Field of Search ..... 123/436, 435, 419

[56] References Cited

U.S. PATENT DOCUMENTS

| | | | |
|---|---|---|---|
| 4,329,960 | 5/1982 | Woodhouse et al. | 123/436 |
| 4,366,793 | 1/1983 | Coles | 123/436 |
| 4,418,669 | 12/1983 | Johnson et al. | 123/436 |
| 4,509,484 | 4/1985 | Gertiser | 123/436 |
| 4,683,856 | 8/1987 | Matsuura et al. | 123/436 |

*Primary Examiner*—Andrew M. Dolinar

*Attorney, Agent, or Firm*—Barnes & Thornburg

[57] ABSTRACT

A method for the regulation of the mixture composition in a mixture-compressing internal combustion engine with an electronically controlled fuel injection system. In order to be able to dispense with a lambda probe, the mixture is initially enriched or leaned for each cylinder unit directly after the start of the internal combustion engine, the change between two successive firings of the energy pulse introduced into the crankshaft by an ignition is continuously determined thereafter and the mixture is enriched in the case that the amount of the respectively determined energy pulse change lies above a predetermined shifting-comparison value dependent on operating parameters, and otherwise is leaned down.

8 Claims, 3 Drawing Sheets

$p_s$
$I_G$
17
$t_{mF(n)}$
19
$D_{tm(st)}$
$t_{mF(n)}$
$p_s$
11
F
12
10
3
13
4
$t_i$
14
$I_{Z1}$
Z = 4
Z = 3
Z = 2
Z = 1
9
8
7
6
V(4)
V(3)
V(2)
V(1)
$t_{i(4)}$
$t_{i(3)}$
$t_{i(2)}$
$t_{i(1)}$
5

$t_i$
$I_G$
$I_{Z1}$
$t_{mF(n)}$
$D_{tm(st)}$
15
6,7,8,9
16
$D_{tm}(Z)$
i(Z)
18
$|D_{tm(Z)}| \geq D_{tm(st)}$ ?
N
J
V(Z)=-1
20
V(Z) = 1
22
V(Z-1)
23
24
27
V(1) = -1
N
V(Z-1)=-1 ?
J
J
(V(1)∧V(2) ∧V(3)∧V(4))=1 ?
N
26
25
21
$t_{i(Z)} = t_i \times (1 + \frac{V(Z)}{S})$
$t_{i(Z)}$

METHOD FOR THE REGULATION OF THE MIXTURE COMPOSITION IN A MIXTURE-COMPRESSING INTERNAL COMBUSTION ENGINE

BACKGROUND AND SUMMARY OF THE INVENTION

The present invention relates to a method for the regulation of the mixture composition in a mixture-compressing internal combustion engine which includes one fuel-injection valve per cylinder unit arranged in the associated suction channel and controllable by an electronic control unit.

In present-day mixture-compressing internal combustion engines having an electronically controlled fuel-injection system (for example, L-Jetronic), whose exhaust gas is after-treated by way of a catalyst, it is customary to regulate the mixture composition by way of a lambda probe arranged in the exhaust gas line of the internal combustion engine. This lambda probe entails the disadvantage that it operates only after it has reached its operating temperature by the exhaust gas or by means of a heating element. If, in order to improve this disadvantage, it is arranged in direct proximity of the internal combustion engine, the danger exists that it may suffer damages as a result of the occurring exhaust gas peak temperatures. Therebeyond with the use of only one lambda probe in the exhaust gas manifold, only the mixture composition for all cylinders can be regulated simultaneously.

The present invention is therefore concerned with the task to provide a method of the type described above in which the use of a lambda probe can be dispensed with.

The underlying problems are solved according to the present invention in that directly after the start of the internal combustion engine, the mixture is initially enriched or leaned down for each cylinder unit and that subsequently the change of the energy pulse between two successive ignitions which is introduced into the crankshaft of the internal combustion engine by an ignition or a parameter corresponding to this magnitude is continuously determined and in that the mixture is then enriched in the case that the amount of the respectively determined energy pulse change lies above a predetermined shifting-comparison value dependent on an operating parameter, and otherwise is leaned down.

The mixture regulation can be carried out with the method according to the present invention, in which a lambda probe can be dispensed with, already directly after the start of the internal combustion engine and more particularly separately for each cylinder so that eventually occurring errors in the air or fuel distribution onto the individual cylinders are immediately compensated for. The control for carrying out the method can be integrated without any problem into the control electronics already present in an electronic fuel injection system so that the realization of the method is connected only with relatively slight costs. A further advantage of the method of the present invention resides in that it can be used not only for the regulation to a stoichiometric mixture composition but also for the regulation of the mixture to the lean limit.

BRIEF DESCRIPTION OF THE DRAWINGS

These and other objects, features and advantages of the present invention will become more apparent from the following description when taken in connection with the accompanying drawing, which shows, for purposes of illustration only, one embodiment in accordance with the present invention, and wherein.

DETAILED DESCRIPTION OF THE DRAWINGS

Figure 1:
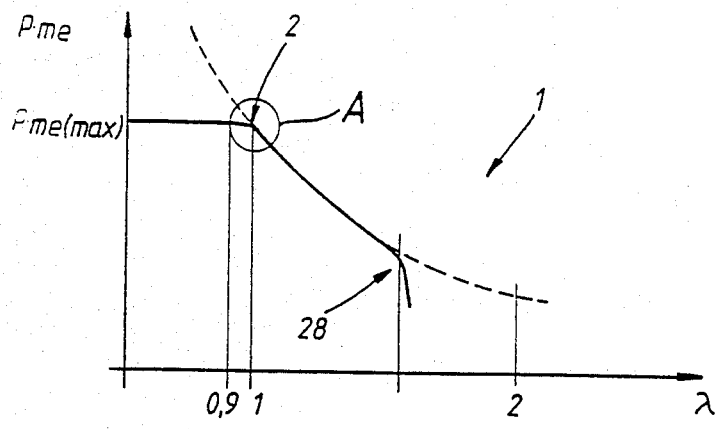
FIG. 1 is a diagram $p_{me}=f(\lambda)$ which illustrates the relationship between the mixture composition and the effective mean pressure $p_{me}$.

Referring now to drawing wherein like reference numerals are used throughout the various views to designate like parts, and more particularly to FIG. 1, this figure illustrates in a diagram generally designated by reference numeral 1 the general relationship in a mixture-compressing internal combustion engine between the effective mean pressure $p_{me}$ and the air ratio number $\lambda$ as measure for the mixture composition. It can be seen thereby that the mean pressure $p_{me}$ continuously decreases at values of $\lambda>1$, for the larger the air excess in the combustion space, respectively, the smaller the fuel quantity combusting during a working stroke, the smaller is also the resulting pressure level in the combustion space as a result of the low energy offer from the fuel and thus also the energy pulse for producing a torque which is introduced into the crankshaft by the combustion. This energy pulse thus continuously decreases with increasing $\lambda$, i.e., with decreasing fuel quantity fed into the combustion space.

Figure 2:
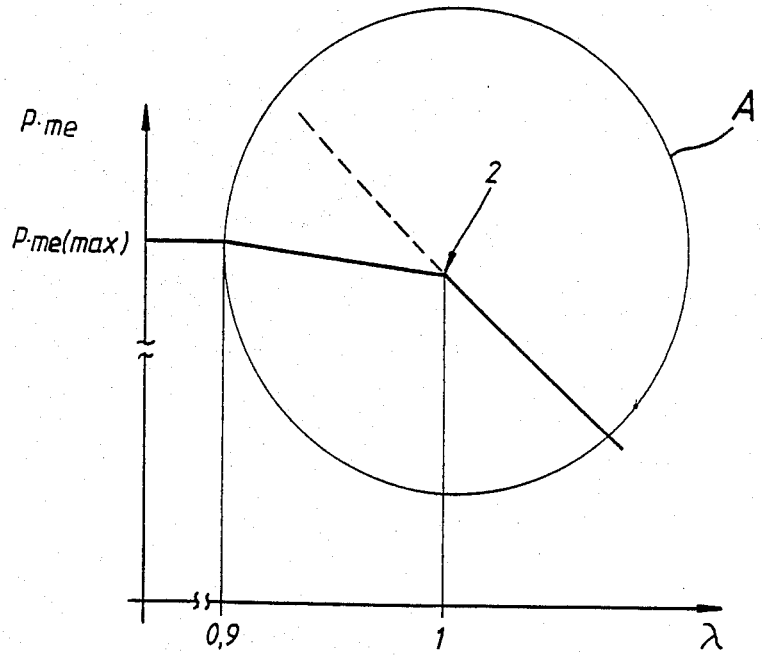
FIG. 2 is an enlarged detail of the shape of the curve according to FIG. 1 within the circle indicated by A in FIG. 1.

At an air ratio number $\lambda$ which is smaller than 1, i.e., at rich mixtures, the fuel quantity which can combust per working stroke, however, remains theoretically the same, for fuel can be converted only to the extent that oxygen is still available at all for the combustion, and as at $\lambda=1$ no air excess exists any longer, also no more fuel can be converted with more rich mixtures than at $\lambda=1$. Thus, the maximum attainable mean pressure $p_{me(max)}$ is reached at $\lambda=1$ and no longer increases with a mixture which becomes more rich. However, in reality it is so that this maximum mean pressure $p_{me(max)}$ is reached only at a $\lambda$ of about 0.9 which can be traced back to the fact that in practice an ideal mixture formation never exists so that a small proportion in still non-combusted fuel is always present in the exhaust gas. This leads to the fact that in the diagram within the range between $\lambda=1$ and $\lambda=0.9$ a slight increase in the direction toward smaller values can still be noted. At any rate, however, the amount of the increase within this range ($0.9<\lambda<1$) is negligible compared to that in the lean range ($\lambda>1$). A bend 2 in the curve configuration thus results at $\lambda=1$ (see also FIG. 2) whereby the curve extends nearly linearly in the areas directly around the location of the bend 2. If the mixture is now leaned down, for example, in small steps ($\lambda\uparrow$) and if during each working stroke the energy pulse introduced into the crankshaft is determined, then a pulse change between two measurements in the rich range ($\lambda<1$) is smaller than in the lean range $\lambda>1$) and for $\lambda<0.9$, the pulse change is even equal to 0. This means also that a pulse change measured in a rich mixture is smaller and a pulse change measured in a lean mixture is larger than a mean or average value formed from these two magnitudes.

The regulation according to the present invention now consists in that during the enrichment or leaning of the mixture, the energy pulse change between two successive ignitions is permanently measured and compared with the predetermined mean value.

If the amount of the pulse change during the enrichment of the mixture is smaller than the mean value, the mixture is already too rich and a "shifting over", so to speak of, must be undertaken in order to lean the mixture again. The leaning will now be continued until the amount of the measured pulse change is again greater than the mean value so that now a "shifting over" takes place again in the direction of enrichment. The mean value thus forms a shifting-comparison value about which the measured pulse changes continuously oscillate. The steps during the leaning and the enrichment are thereby chosen so small that a nearly stoichiometric mixture exists quasi-continuously, i.e., $\lambda=1$ is provided.

Figure 3:
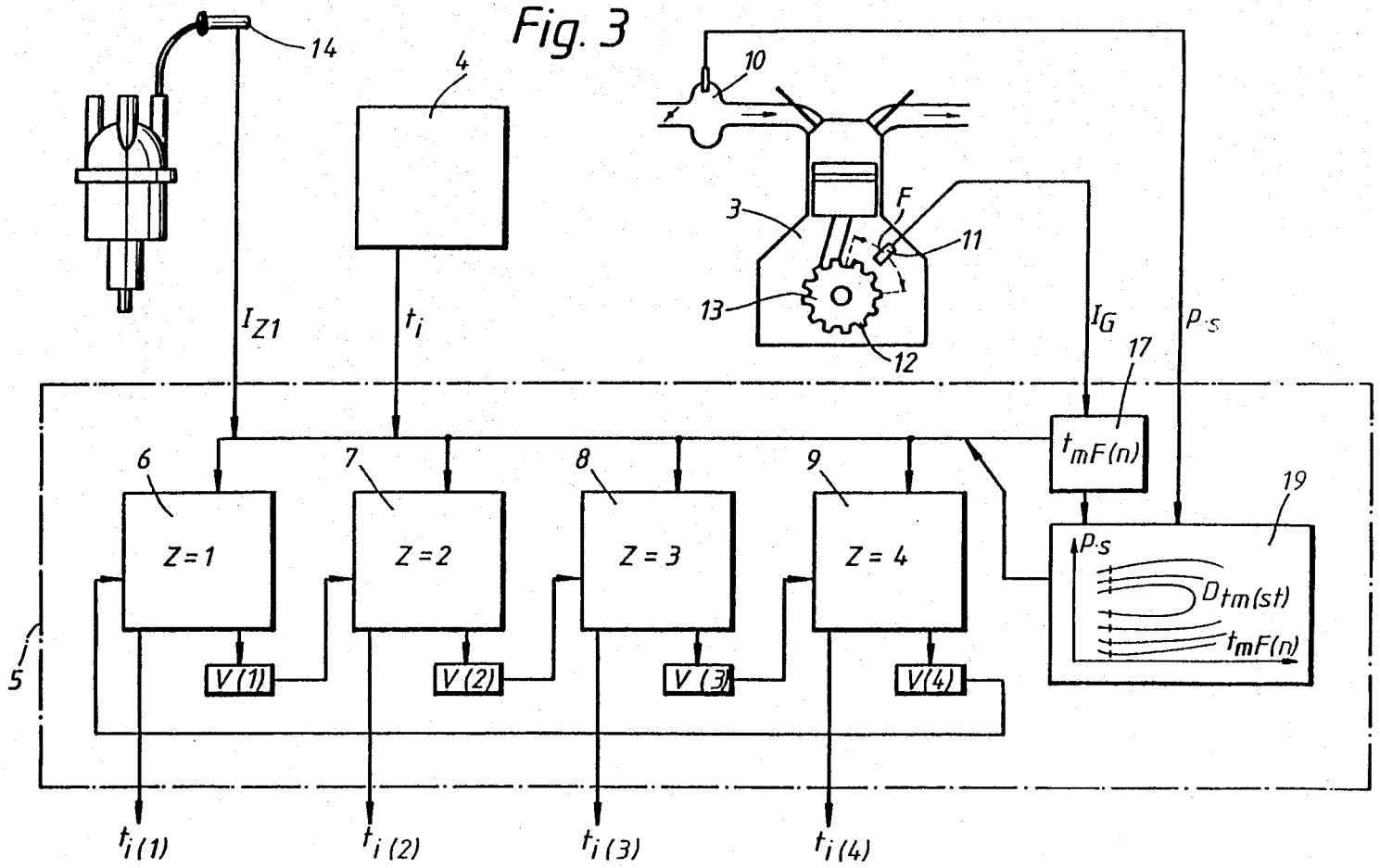
FIG. 3 is a schematic block diagram of the control system for carrying out the method in accordance with the present invention.

FIG. 3 illustrates the construction in principle of a control system for carrying out the method in a four-cylinder, mixture-compressing internal combustion engine 3 with an electronically controlled fuel injection device whose manner of operation coincides with the known L-Jetronic system. The mixture composition is thereby determined by way of the fuel injection duration $t_i$ determined by the electronic control unit 4 of the fuel injection device dependent on operating parameters. (FIG. 3 illustrates for the sake of simplicity only one cylinder unit). The injection duration $t_i$ determined by the control unit 4 depending on the operating condition, which initially is identical for all cylinders, is now matched according to the present invention in an additional control block 5 specially to each cylinder Z depending on mixture composition. In particular, this takes place in the four blocks 6 to 9. For that purpose the pressure $p_s$ in the suction pipe 10 of the internal combustion engine as measure for the actual load, a pulse signal $I_G$ characterizing the rotary movement of the crankshaft of the internal combustion engine 3 by means of a pulse transmitter 11 which is arranged on the starter gear rim 12 of the flywheel 13 mounted on the crankshaft, the injection duration $t_i$ for all cylinders Z determined in a known manner by the control unit 4 and an ignition pulse signal $I_{Z1}$ from the ignition cable 14 of the first cylinder are thereby fed to the control block 5.

Figure 4:
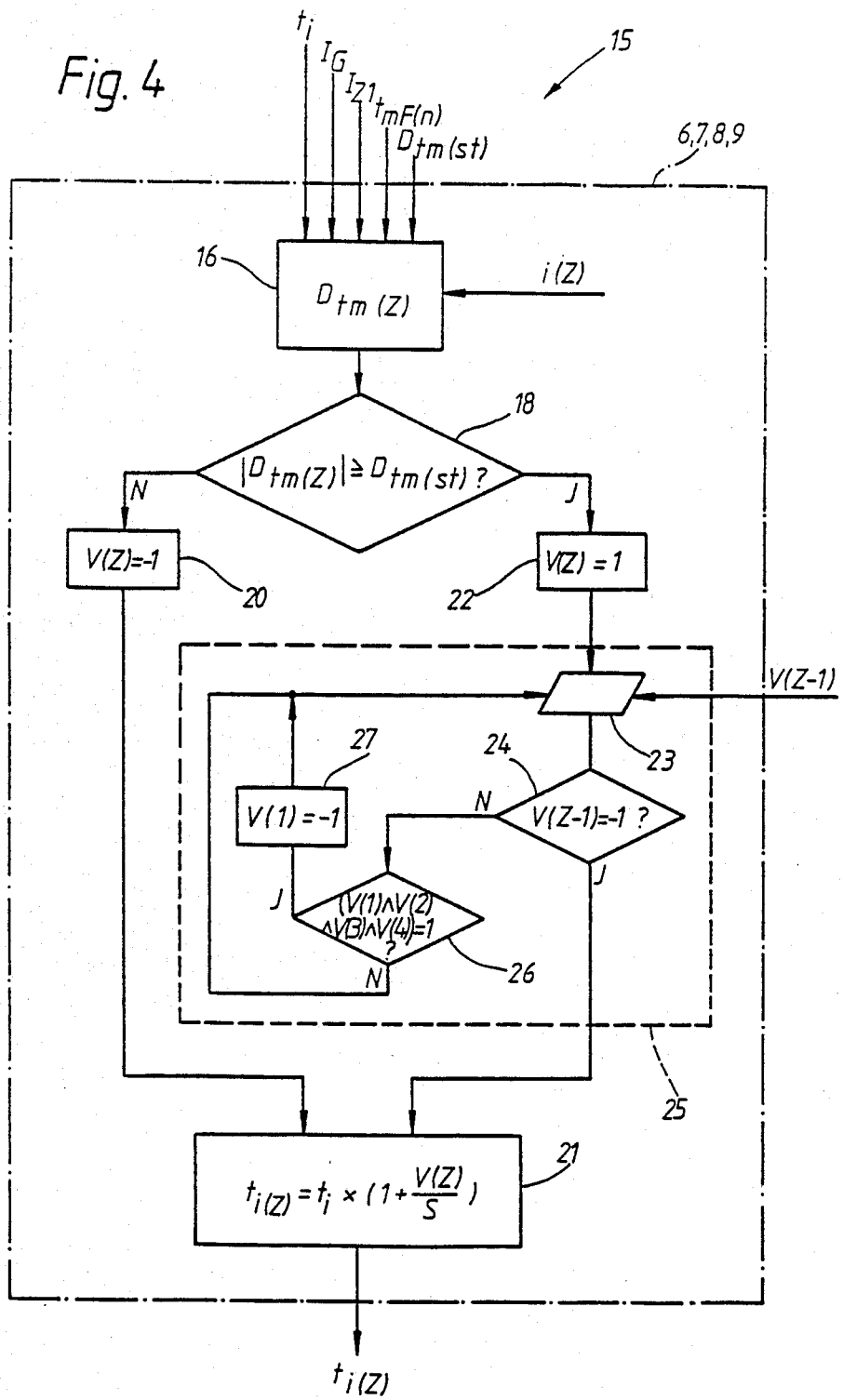
FIG. 4 is a flow chart indicating the determination of the fuel injection duration $t_{i(Z)}$ for each cylinder Z.

The determination of the injection duration $t_{i(Z)}$ for each individual cylinder Z from the output signal of the control unit 4 (blocks 6 to 9) takes place in the same manner for all cylinders and is illustrated in principle in FIG. 4 in the form of a flow diagram.

At first the mean change $D_{tm(Z)}$ of the energy pulse introduced into the crankshaft by the combustion in the cylinder Z is determined in the block 16 from the input magnitudes $I_G$ and $I_{Z1}$.

The time $t_{ZF(n)}$ between the movement of a fixed number of teeth F (F is used for "window") is measured for that purpose with the aid of the transmitter 11 at the toothed starter rim 12 within a range of minimum 20° up to maximum 90° after the ignition top dead center of the cylinder (Z). The window is located between 20° to 90° after the ignition top dead center for the reason that within this range, the essential part of the energy conversion in the cylinder Z has occurred (see FIG. 3).

Independently therefrom, the time $t_{u(n)}$ for a crankshaft rotation (n=index for the rotation) is measured independently therefrom in a separate block 17 (FIG. 3). This time is reduced to the value $t_{mF(n)}$ by division with the total number of teeth and multiplication with the window number of teeth F to a mean rotational speed for the respective rotation n to the window F.

$$t_{mF(n)} = \frac{t_{u(n)} \times \text{window number of teeth}}{\text{total number of teeth}}$$

This value $t_{mF(n)}$ which is just valid at a given time, is now fed to the respective block 6, 7, 8 or 9, depending on which cylinder Z is undergoing at that instant the working stroke (see also FIG. 3).

The difference $$\Delta t_{Z(n)} = t_{mF(n)} - t_{ZF(n)}$$

now represents a measure for the magnitude of the energy pulse which has been introduced into the flywheel 13 as a result of the combustion in the cylinder Z. The greater the introduced energy, the shorter will become $t_{ZF(n)}$ (passage through the window F) and the larger becomes $\Delta t_{Z(n)}$. The value $\Delta t_{Z(n)}$ is thus proportional to the energy pulse of the cylinder Z.

The enrichment or leaning of the mixture during each rotation of the internal combustion engine 3 in small steps now effects a proportional change of the energy pulse from ignition to ignition. The pulse change $D_{tZ(n)}$ is determined from the difference of $\Delta t_{Z(n)}$ and the pulse of the previous rotation $\Delta t_{Z(n-1)}$.

$$D_{tZ(n)} = \Delta t_{Z(n)} - \Delta t_{Z(n-1)}$$

For smoothing out this value, the mean pulse change is then formed from a number $i_{(Z)}$ of energy pulse changes $D_{tZ(m)}$ $$D_{tm(Z)} = \frac{\sum_{1}^{i(Z)} D_{tZ(n)}}{i_{(Z)}}$$

During the start of the internal combustion engine $D_{tm(Z)}$ is set to the value 0, i.e., one will start from a rich mixture ($\lambda \approx 0.9$).

After the determination of $D_{tm(Z)}$, it is examined in the branching block 18 (FIG. 4) whether the amount $|D_{tm(Z)}|$ of this mean energy pulse change $D_{tm(Z)}$ is larger than or equal to a predetermined shifting-comparison value $D_{tm(st)}$.

This value $D_{tm(st)}$ is predetermined from a stored performance graph 19 consisting of a set of characteristic curves (see FIG. 3) in dependence of the just prevailing load at that time (suction pipe pressure $p_S$) and the just prevailing internal combustion rotational speed prevailing for which the magnitude $t_{mF(n)}$ is a measure. The values for $D_{tm(st)}$ are determined as follows:

On an engine test stand several mean energy pulse changes $D_{tm(Z)}$ for mixture compositions of $\lambda < 0.96$ and $\lambda > 1.04$ are statically measured during enriching and leaning down in dependence on predetermined rotational speed and load support places. A mean value is formed from the "lean" and the "rich" energy pulse change amounts $|D_{tm(Z)}|$ which is then stored in a performance graph 19 as shifting-comparison value $D_{tm(st)}$ corresponding to the support places (FIG. 3).

The enriching, respectively, leaning of the mixture takes place with a constant step width.

If it follows from the interrogation in the block 18 (FIG. 4) that the amount $|D_{tm(Z)}|$ which has just been determined is smaller than the associated shifting-comparison value $D_{tm(st)}$ read out from the performance graph 19, i.e., if the mixture is still too rich, then a shifting variable V(Z) is set in the block 20 to a value of $-1$ which effects in the block 21 connected thereto that the injection duration $t_i$ predetermined by the control unit 4 is reduced for the cylinder Z which has just been measured, i.e., a leaning will take place. The step width with which the injection duration $t_{i(Z)}$ is changed for each cylinder Z, is dependent on the magnitude S which is fixedly predetermined whereby an inverse proportional relationship exists between the magnitudes S and $t_{i(Z)}$. If the interrogation in the block 18 is to be answered by yes, i.e., with too lean a mixture, the shifting variable V(Z) is set in the block 22 to the value 1 in order to enrich the mixture again. In order that the mixture cannot be enriched simultaneously in all four cylinders, an enriching of a cylinder Z is possible only when the cylinder Z−1 which fired before, has just been leaned down. An input block 23 adjoins for that purpose the output of block 22, to which is transferred the status of the shifting variables V (Z−1) of the previously firing cylinder Z−1 (see also FIG. 3 transfer of V(1) to V(4)).

If leaning down just takes place in the cylinder firing prior thereto (branching block 24), then the control connects through to the block 21 so that now by reason of the positive shifting variable V(Z)=1 (block 22), the mixture of the cylinder can again be enriched, and more particularly by a stepwise increase of the injection duration $t_i$ predetermined by the control unit 4. If, in contrast thereto, enrichment had just taken place in the cylinder Z−1 firing before, then the control branches back to the input block 23. The control now passes through the loop 25 for such length of time until the shifting variable is V (Z−1)=−1. However, in order to prevent that the mixture is too lean at the same time in all four cylinders, -- V(1)=V(2)=V(3)=V(4)=1 would mean that the control for each cylinder would remain in the loop 25--a branching (block 26) is additionally provided in the loop 25 which is followed by a block 27 for the case that the mixture of all four cylinders to too lean, whereby the shifting variable V(1) for the first cylinder is set in the block 27 to −1 so that the mixture of the cylinders next to fire can again be enriched. An excessive leaning of the mixture of the first cylinder is nonetheless prevented in this case, for it will be recognized already during the next interrogation in the block 24 that it should not be further leaned down and V(1) is again set to 1.

Four adjusting value signals $t_{i(1)}$ to $t_{i(4)}$ thus always exist in the output of the control block 5 (FIG. 3) which correspondingly control the fuel injection valves (not shown) that are arranged in the suction channels of the individual cylinders. It is thus assured that a nearly stoichiometric mixture ($\lambda=1$) exists in each of the four cylinders at any point in time. The control block 5 (FIG. 3) was illustrated for the sake of simplicity as an operating unit separate from the control unit 4, however, the control block 5 can, of course, also be integrated into the control electronics of the control unit 4.

The method according to the present invention can also be used equally well for the regulation of the mixture composition at the lean limit, for in this range 28 (see FIG. 1) the effective mean pressure $p_{me}$ also changes in a non-uniform manner within this range 28 (FIG. 1). Thus, the amount of the slope of the graphs above the lean limit, inter alia, also conditioned by ignition misfirings occurring beginning with the lean limit, is considerably greater than below the lean limit. With the regulation at the lean limit, it is only necessary to have reference to another performance graph in the comparison of $|D_{tm(Z)}|$ with $D_{tm(st)}$ (FIG. 4, block 18), in which the shifting-comparison values at the lean limit are stored dependent on load and rotational speed.

In order to be able to realize a rich mixture during the warm-up phase, it is feasible in the determination of the first value for $D_{tm(Z)}$ to select $i_{(Z)}$ relatively large so that within this operating range a mean energy pulse change $D_{tm(Z)}$ is the basis for the determination of $t_{i(Z)}$ which is equal to 0 (starting value for $D_{tm(Z)}$) and thus a $\lambda$ of about 0.9 is present.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A method for the regulation of the mixture composition in a mixture-compressing internal combustion engine which includes for each cylinder unit a fuel injection valve arranged in the associated suction channel and controllable by an electronic control unit, comprising the steps of initially enriching or leaning the mixture for each cylinder unit, directly after the start of the internal combustion engine subsequently continuously determining the change of the energy pulse introduced into the crankshaft of the internal combustion engine by an ignition between two successive ignitions or a parameter corresponding to this magnitude, and then enriching the mixture in the case that the amount of the respectively determined energy pulse change lies above a predetermined shifting-comparison value dependent on operating parameters and otherwise leaning the mixture, and wherein the enriching of the mixture of a cylinder unit takes place only when the mixture of the cylinder unit firing just prior thereto has just been leaned.

2. A method according to claim 1, in which the shifting-comparison value is determined from a performance graph stored in a fixed value memory of the electronic control unit in which the shifting-comparison values are stored as mean values from energy pulse changes measured under stationary conditions with rich and with lean mixtures dependent on load and rotational speed.

3. A method according to claim 2, wherein the enriching or the leaning of the mixture takes place stepwise.

4. A method according to claim 3, wherein the mixture regulation takes place in dependence on a mean energy pulse change which is formed from the sum of several individual energy pulse changes in relation to the number thereof.

5. A system, for the regulation of the mixture composition in a mixture-compressing internal combustion engine which per cylinder unit includes a fuel-injection valve arranged in its associated suction channel and controllable by an electronic control unit, comprising first means for initially enriching or leaning the mixture for each cylinder unit directly after the start of the internal combustion engine, second means for continuously determined thereafter the change of the energy pulse introduced into the crankshaft of the internal combustion engine by an ignition between two successive ignitions or a parameter corresponding to this magnitude, and third means for enriching the mixture in case the amount of the respectively determined energy pulse change lies above a predetermined shifting-comparison value dependent on operating parameter and in the alternative for leaning the mixture and wherein said third means is operable to enable an enrichment of the mixture of a cylinder unit only when the mixture of the cylinder unit firing prior thereto has just been leaned.

6. A system according to claim 5, further comprising means for determining the shifting-comparison value from a set of characteristic curves stored in a ROM of the control unit, in which the shifting-comparison values are stored as mean value from energy pulse changes measured under stationary conditions with rich and lean mixtures as a function of load and rotational speed.

7. A system according to claim 6, wherein the third means is operable to enrich, respectively, lean the mixture stepwise.

8. A system according to claim 7, wherein the mixture regulation takes place as a function of a mean energy pulse change which is formed from the sum of several individual energy pulse changes in relation to the number thereof.

* * * * *